United States Patent [19]

Newcombe

[11] Patent Number: 4,738,751

[45] Date of Patent: Apr. 19, 1988

[54] FABRIC EDGE SUPPORT APPARATUS FOR FOURDRINIER PAPER MACHINE

[75] Inventor: Doug Newcombe, Appleton, Wis.

[73] Assignee: Appleton Specialty Products, Inc., Appleton, Wis.

[21] Appl. No.: 810,350

[22] Filed: Dec. 18, 1985

[51] Int. Cl.[4] ..... D21F 1/00

[52] U.S. Cl. ..... 162/353; 162/35 A

[58] Field of Search ..... 162/353, 35 A, 348, 162/295, 272, 273; 209/307, 308, 409; 493/395, 460, 461, 462, 465; 210/400, 401, 499, 541

[56] References Cited

U.S. PATENT DOCUMENTS

| | | | |
|---|---|---|---|
| 2,094,350 | 9/1937 | Cartigny | 210/401 |
| 2,314,294 | 3/1943 | Wallny | 210/401 |
| 3,480,509 | 11/1969 | Stein | 162/353 X |
| 3,928,124 | 12/1975 | Hansen | 162/354 X |
| 4,124,441 | 11/1978 | Nykopp | 162/353 X |

*Primary Examiner*—Peter Chin
*Assistant Examiner*—Thi Dang
*Attorney, Agent, or Firm*—James E. Nilles; Nicholas A. Kees

[57] ABSTRACT

A Fourdrinier-type paper machine having a wet end with a headbox for storing a mixture of pulp and water, this pulp mixture being jetted onto a fabric having two side edges, this fabric forming an endless belt the upper surface of which is caused to continuously move away from the headbox, including an apparatus for continually supporting and curling the edge of the fabric so as to prevent loss of pulp mixture off the sides of the fabric and so as to prevent edge wave formation which would require substantial trimmage and waste. The apparatus includes a pair of bars having a wedge-shaped cross-section, one edge of each inserted under one side of the fabric, to cause the edge of the fabric to curl upward. Apparatus is provided to adjust the amount of curl. Several of these curl adjusting apparatuses are placed along the length of the bars so that the amount of curl can be different at different points along the bars. For instance, the curl might be greatest at the point where the pulp hits the fabric, and it may be slowly tapered to zero over the length of the bars. The upper surface of the fabric is also caused to continuously move from side to side, and an end block is provided at the leading edge of each bar to prevent the fabric from running off the edge of the bar during the course of any lateral movement of the fabric.

5 Claims, 3 Drawing Sheets

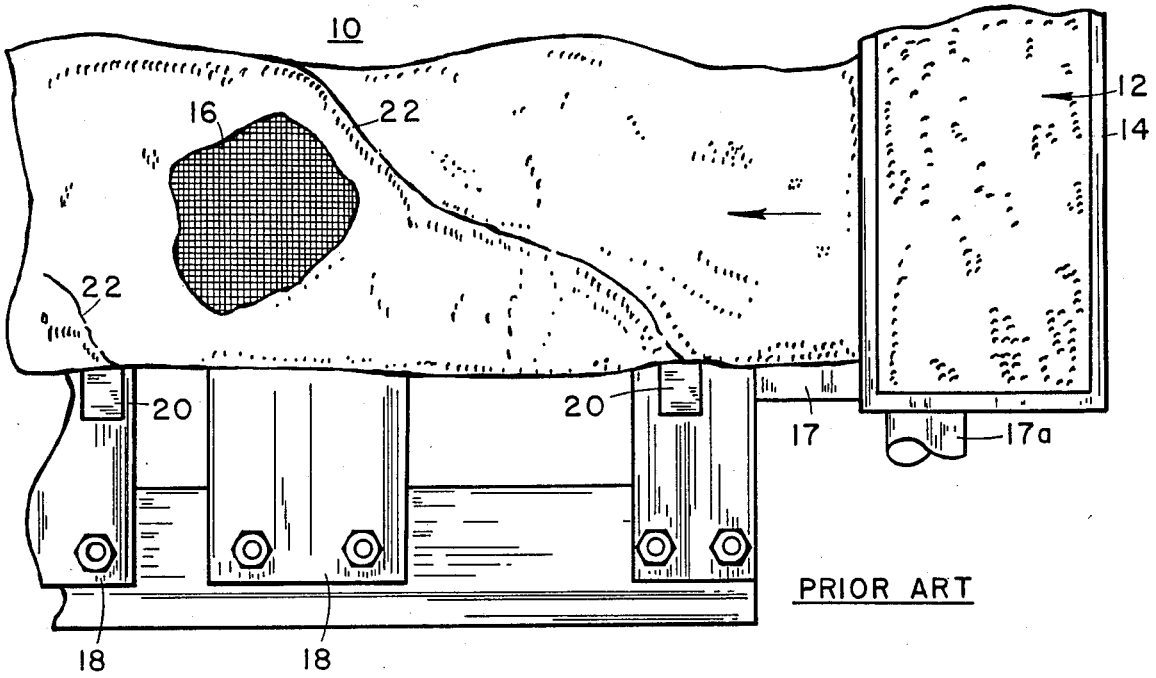
FIGURE 1
FIGURE 2
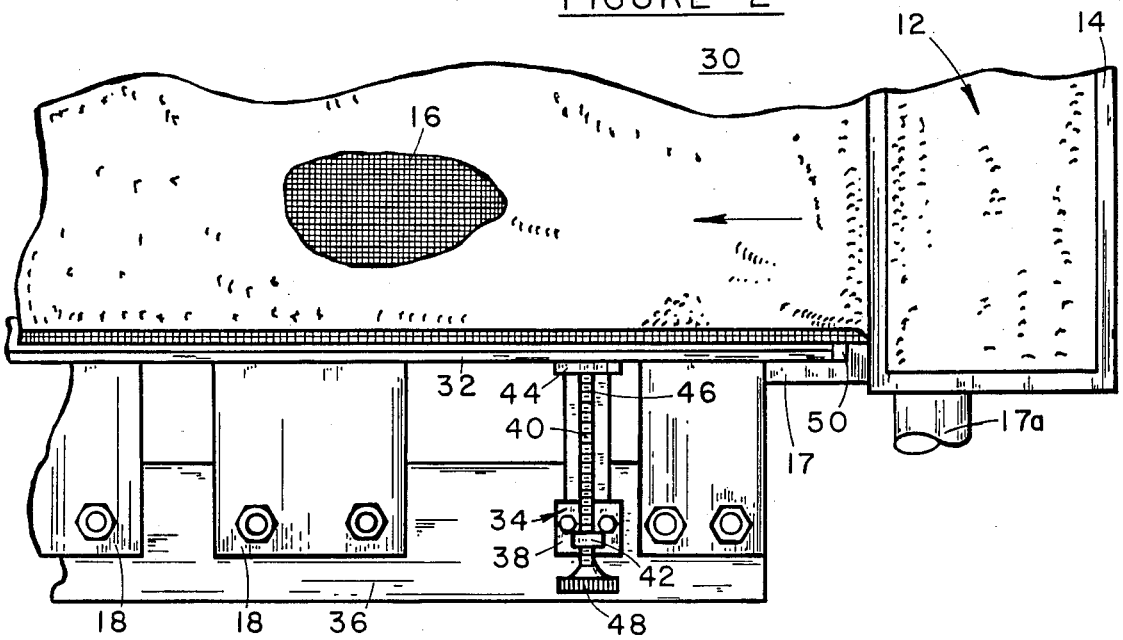

FABRIC EDGE SUPPORT APPARATUS FOR FOURDRINIER PAPER MACHINE

BACKGROUND OF THE INVENTION

This invention relates to a Fourdrinier-type paper machine and an apparatus for improving the operation of and reducing the waste produced by such paper machine. In particular, it relates to an apparatus to be added to the wet end of such a paper machine to prevent the wet pulp mixture from draining off the side of the fabric, without causing the usual large edge wave by providing continuous support, adjustable in amount along its length, for a curl in the edge of the fabric.

When the Fourdrinier Paper Machine was invented many years ago for making paper on a continuous basis a device was required to "hold" the mixture of fiber and water on the endless wire. A special "dam" was designed for that purpose and was called a "Deckle Strap". It consisted of an endless rubber strap, approximately 2 inches square in cross section by whatever length was needed—usually enough to travel with the Fourdrinier wire a distance of two thirds of the flat area length before returning to the starting point at the headbox. This quite adequately held the mixture of 1% fiber and 99% water on the Fourdrinier wire until enough water had been drained from the mixture for the sheet to solidify and form with no further danger of spillage over the edge, as long as lineal speeds were kept low.

When the machine speed was increased, however, it became difficult to keep the deckle strap on the supporting pulleys or "wheels". To overcome this problem the "Deckle Straps" were replaced by "Deckle Boards" fastened to the outlet of the headbox. The "Deckle Boards" were stationary and had to be sealed to the wire to prevent leakage. A rubber strip set in the botto of the "Deckle Board" provided the seal but it also caused additional problems. In spite of constant water lubrication between the moving wire and the stationery rubber strip, the wire or fabric wore and became unusable and stock rolled up into small balls or "dams" at the rubber seals. Each time the mixture came in contact with one of these small "dams", or obstructions, it literally threw the flow away from the edge in a wave-like pattern out toward the center of the forming sheet, causing the edge of the sheet to be thinner and with a slight ridge at the center of the wave. This clearly was detrimental to production as this entire area of the sheet could not be used and had to be trimmed off before the final processing.

As the machine speed and the cost of the fabrics increased it became obvious that some new method of containing the stock and water mixture on the fabric had to be devised. The paper mills started to use small wedge-shaped blocks, sometimes called "Curl Blocks", between the fabric and the drainage elements to raise the edge of the fabric to form a sort of a continuous "pocket". This worked quite well as far as fabric wear was concerned but did little or nothing to eliminate the edge wave problem and did not even completely prevent edge spillage. The blocks could not be placed close enough to the headbox to be effective and the fabric sagged between the blocks. Even though there were no obstructions in the form of rolled up stock "dams", the initial jet of pulp and water hit the fabric before it was fully turned up, or curled, to form the containing pocket and an edge wave resulted. Additional edge waves formed at each following block because of the sagging fabric. As speed increased, the placement of the blocks became more and more critical, if not impossible, and even greater edge waves formed. It was not at all unusual to have the basis weight of the edges of the sheet on the order of 20% to 25% less than the balance of the sheet width. The "bad" edges had to be trimmed off and production suffered.

The invention relates to improvements over the apparatus described above and to solutions to the problems raised thereby.

SUMMARY OF THE INVENTION

This invention includes a pair of long blocks, each having a curved, concave upper surface, placed one on the drive side and one on the tending side of the fabric, with one edge of the respective block having been slid under each side of the fabric. The leading edge of each block is located at a point closer to the headbox than the landing area of the pulp leaving the headbox. The blocks are adjusted by adjusting devices so that the fabric edges are allowed to uncurl back to the flat position slowly some distance away from the headbox. This apparatus almost completely eliminates edge waves so that nearly the full width of the sheet can be used as the final production from the machine, with very little waste.

This invention comprises a Fourdrinier-type paper machine having a wet end with a fabric forming an endless loop the upper surface of which is caused to move continuously away from aNheadbox where a pulp mixture is stored prior to jetting onto the fabric including an apparatus which continuously supports a curl in the edge of the fabric, beginning before the landing area of the pulp on the fabric.

A more specific aspect of the invention has adjusting devices so that the fabric is curled when the pulp is first placed on it, and so that the fabric is allowed to slowly uncurl some distance from the headbox.

Other aspects and advantages of the invention will become apparent hereinafter.

DESCRIPTION OF THE DRAWINGS

FIG. 1 is a top view of a prior art fabric edge support apparatus.

FIG. 2 is a top view of one embodiment of the invention.

DESCRIPTION OF THE PREFERRED EMBODIMENT

Figure 3:
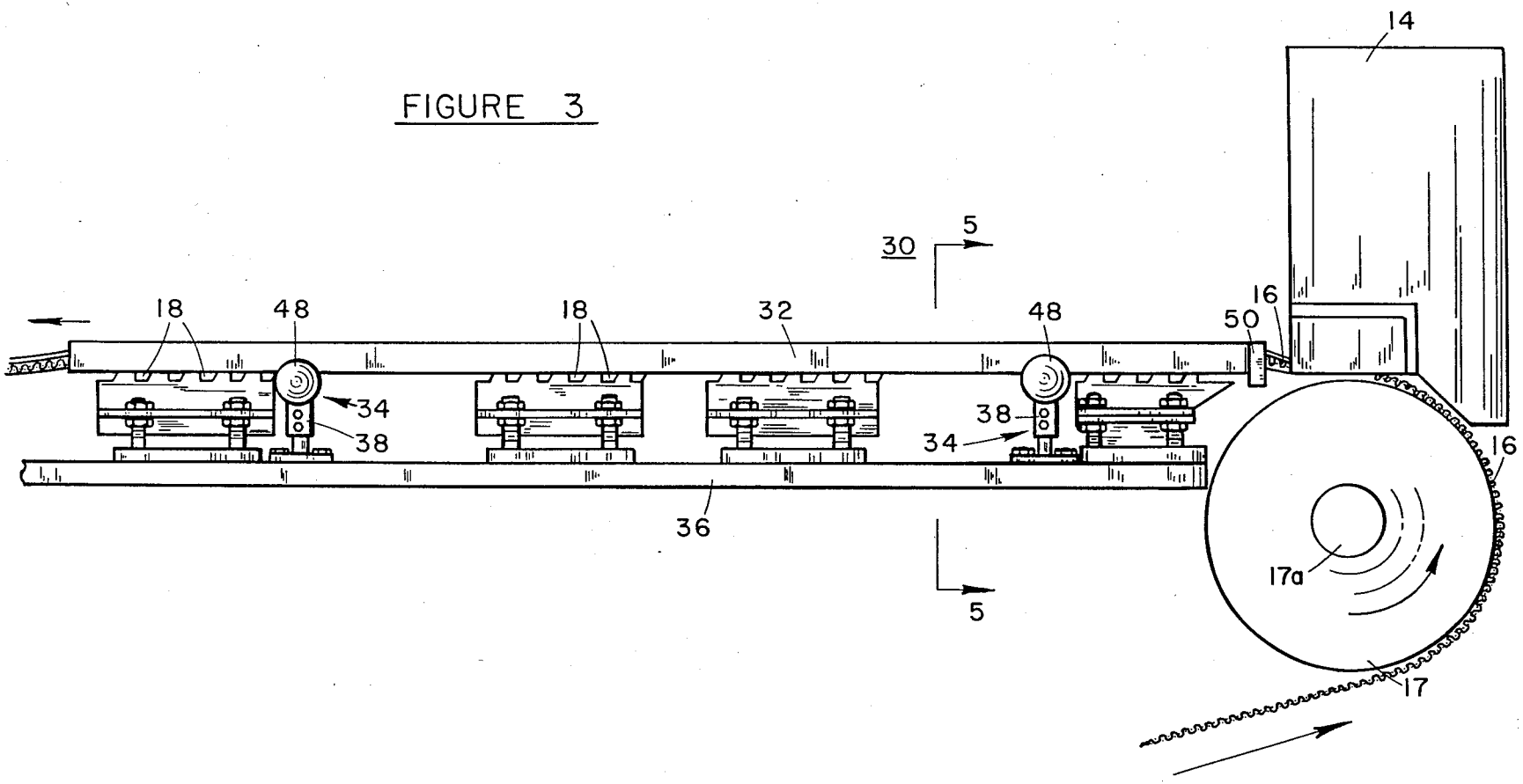
FIG. 3 is a side view of the embodiment shown in FIG. 2.

Referring now to FIG. 1, there is shown in top view a conventional wet end of a Fourdrinier-type paper machine, generally at 10. An amount of pulp mixture 12 is shown stored in the headbox 14. This pulp mixture is about one percent pulp and 99 percent water. The pulp mixture 12 is then jetted onto the fabric 16, where the water begins to be drained from the pulp. Fabric 16 is generally made of woven wire, although other suitable materials may be used. Fabric 16 forms an endless belt the upper surface of which is caused to continuously move away from headbox 14, in the direction shown, by a drive roller 17, driven via a shaft 17*a* by a prime mover (not shown). The entire width of the fabric 16 is supported by conventional support means such as foil blades or table rolls 18. Periodically along the length of the fabric are placed curl blocks 20 which have a concave upper surface. These curl blocks 20 cause the edge of fabric 16 to curl upward near each block so as to prevent or at least reduce the spillage of the pulp mixture off the side of the fabric. However, between curl blocks 20 the fabric 16 uncurls again until the next curl block 20 is encountered. When a curl block 20 again is encountered, the fabric 16 is again caused to curl upward. This up-and-down motion of the fabric 16 causes a wave 22 in the as yet unsolidified pulp mixture 12 on the fabric. The result is uneven distribution of the pulp on the fabric, producing a sheet of paper having a varying basis weight across its width. Since this condition is unacceptable, the areas where the basis weight is outside of the specified basis weight range must be trimmed off, thereby increasing waste.

Referring now to FIGS. 2 and 3, the apparatus embodying the present invention, indicated generally at 30, still includes a pulp mixture 12 in mostly liquid form held in a headbox 14. Pulp 12 is still jetted onto the fabric 16, which is still driven by a drive roller 17 and supported across its width by foil blades or table rolls 18. As with the apparatus shown in FIG. 1, the foil blades 18, as shown best in FIG. 3, are still partially wedge shaped at the leading edge so as to aid in removal of the water from the pulp mixture 12 on the fabric 16.

Figure 4:
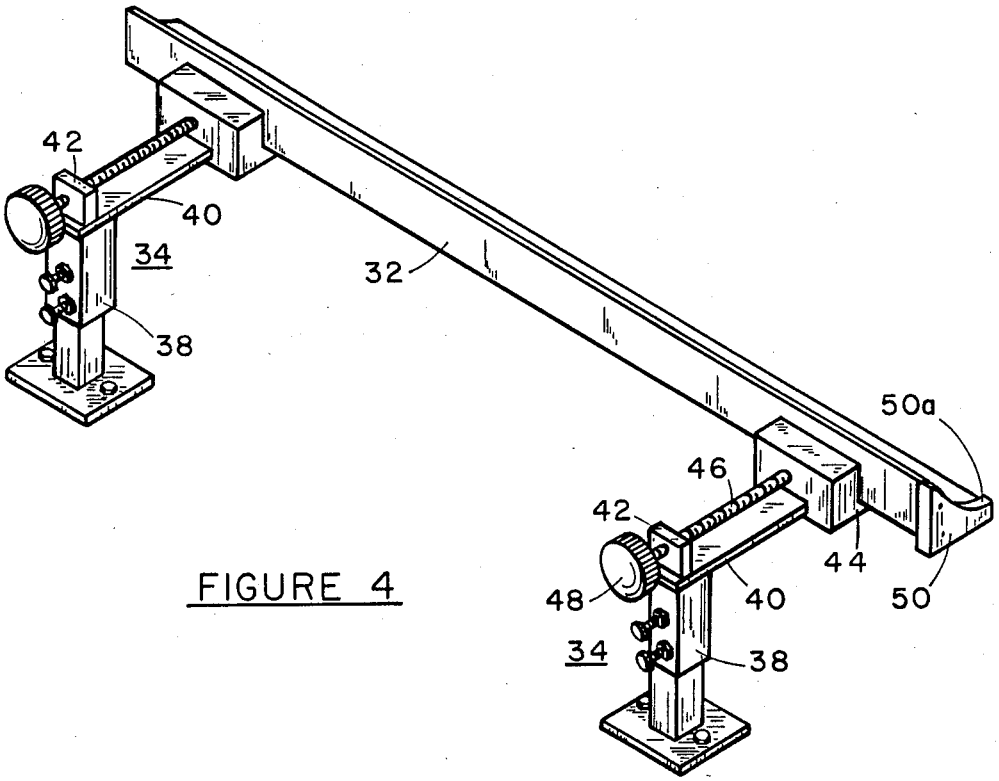
FIG. 4 is an isometric view of the edge support apparatus and associated support hardware.
Figure 5:
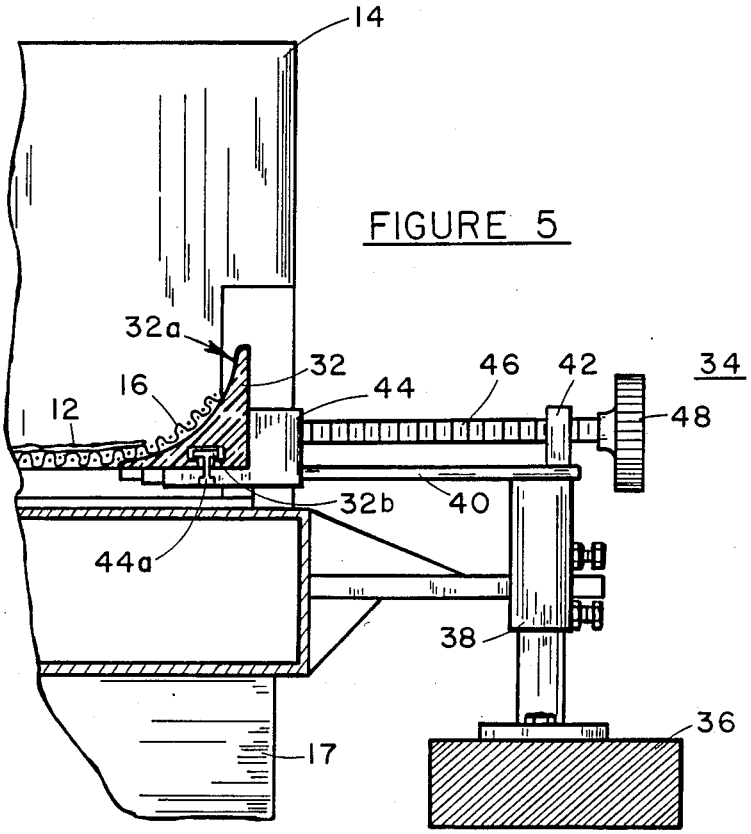
FIG. 5 is a partial sectional view of FIG. 2, taken along line 5—5.

The critical difference between the apparatus shown in FIG. 1 and the instant invention is the means by which support is provided to curl the fabric upward at the side edges. FIG. 4 is an isometric view of the apparatus provided for this purpose. Relating FIGS. 2 and 3 to that figure, it can be seen that the apparatus includes a long bar 32. As can be seen best at FIG. 5 in cross-section, bar 32 may have a generally right-triangle-shaped cross-section, the hypotenuse **32*a* of which may be concave. One corner of this bar 32 is inserted under the edge of fabric 16, causing the fabric to curl upward. Because of the cross-sectional shape of the bar 32**, as it is inserted further under the fabric, it causes the fabric to curl further.

As shown in FIGS. 2–5, bar 32 is supported by a plurality of adjustable support apparatuses, indicated generally at 34, providing support at several different places or locations along the length of bar 32. Each support apparatus 34 rests on the frame 36 of the papermaking apparatus 30. It includes an upstanding stand portion 38, which may be of adjustable height. Preferably at the top of stand 38 is mounted a slider bar 40 and a screw block 42. Mounted on the distal end of slider bar 40 is a slider block 44, which is in turn attached to bar 32. While any suitable means of attachment is included in the invention, the most preferred embodiment as shown in the drawing figures includes a T-shaped opening **32*b* along the length of the bottom surface of bar 32. This opening 32*b* is sized to fit snugly onto a T-shaped projection 44*a* reaching upward from slider block 44. Thus bar 32 can be slid lengthwise onto a plurality of support apparatuses 34, and thereafter tightened down to the respective slider blocks 44 by any suitable means such as set screws. The T-connection then prevents any movement of bar 32 with respect to slider blocks 44**, even though installation of the bar to the blocks is simple and quick.

The support apparatus 34 is completed by a threaded rod 46, one end of which is journalled in slider block 44. Rod 46 is threaded through screw block 42 and terminates at its other end in a handle, crank, or knob 48 for facilitating the turning of rod 46. Hence, as shown best in FIG. 5, as knob 48 and rod 46 are turned one way, the portion of bar 32 supported by the respective slider block 44 is moved further under fabric 16, as slider block 44 slides along slider bar 40, causing the edge of fabric 16 to curl more. When knob 48 is turned the other way, that portion of bar 32 is slid partially out from under fabric 16 reducing the curl. Notice that in FIG. 4 the separate support apparatuses 34 are not ganged or joined to each other in any way. For this reason, bar 32 can be set to cause different amounts of curl in the fabric 16 along the length of the bar. Accordingly, for instance, it is normally desirable to set the bar 32 so as to cause a substantial amount of curl in fabric 16 at the end near the beadbox 14 (FIG. 3), and to have that amount of curl achieved before the pulp mixture 12 hits the fabric. The amount of curl can then be slowly tapered down to zero or nearly zero by the time the fabric reaches the opposite end of bar 32. By this means, the problems of waves and uneven basis weight causing waste are eliminated since the great majority of the water in the mixture has been drained out and the risk of loss of mixture off the side of the fabric is reduced.

In a conventional wet end the fabric, besides obviously being moved forward at high speed, is moved laterally back and forth up to one-half inch or more, in order to reduce wear on the associated parts to an extent at least. The present invention provides means for preventing the fabric from running off the edge of bar 32 entirely and causing damage to the fabric and apparatus. An end block 50, shown best in FIGS. 3 and 4, has a lower portion **50*a* (FIG. 4) which extends further under the fabric 16 than does the lower portion of bar 32, although the curve of the upper surface of end block 50 matches that of bar 32. One such end block 50 is attached to the leading edge of each of the two bars 32 employed to curl the sides of fabric 16. Thus if in the course of the lateral movement of fabric 16 it would move so far as to run off the edge of bar 32, end block 50** provides an extra margin of safety to bring the fabric safely back onto the bar.

While the apparatus hereinbefore described is effectively adapted to fullfil its intended objectives, it is to be understood that the invention is not intended to be limited to the particular preferred embodiments of fabric edge support apparatus herein set forth. Rather, the invention is to be taken as including various equivalents without departing from the scope of the appended claims.

What is claimed as the invention is:

1. In a Fourdrinier-type paper machine having a wet end with a headbox for storing pulp mixture and supported by a support frame, said pulp mixture being jetted onto a fabric having two side edges, said fabric forming an endless belt the upper surface of which is caused to continuously move longitudinally away from said headbox as well as side to side, said upper surface being supported by a plurality of transversely arranged foil blades having a belt-supporting surface of predetermined width, adjacent foil blades being spaced apart by predetermined spacing, an apparatus for supporting and curling said side edges of said fabric comprising:

support means connected to said support frame; and a pair of bars, each supported by said support means, each having a length greater than at least two foil blade surface widths and one spacing between adjacent foil blades, and each having a wedge-shaped cross-section, one edge of each bar being inserted under each side edge of said fabric, thus providing continuous support for curling each edge of said fabric upward for a distance greater than at least two foil blade surface widths and one spacing between adjacent foil blades;

each of said bars having a face facing toward said fabric and each said bar face being concave so that said fabric curls at each edge as each bar is inserted thereunder and as each fabric edge passes over each bar;

said support means including a plurality of independent adjusting means connected to each said bar for adjusting each of said bars transversely to the direction of said longitudinal movement of said upper surface so as to enable said bars to continuously change the amount of curl in each edge of said fabric from a leading end to a trailing end of the bars.

2. A paper machine as recited in claim 1 further comprising means for preventing said fabric from running off the edge of said bars inserted under the side edge of said fabric in the course of its side to side motion, comprising end blocks, each being attached to a leading edge of said bar.

3. In a Fourdrinier-type paper machine having a wet end with a headbox for storing pulp mixture and supported by a support frame, said pulp mixture being jetted onto a fabric having two side edges, said fabric forming an endless belt the upper surface of which is caused to continuously move longitudinally away from said headbox as well as side to side in the course of its longitudinal motion, an apparatus for supporting and curling said side edges of said fabric, comprising:

support means connected to said support frame;

a pair of bars, each supported by said support means, and each having a wedge-shaped cross-section, one edge of each bar being inserted under each side edge of said fabric, thus providing continuous support for curling each edge of said fabric upward for the length of the bars;

each of said bars having a face facing toward said fabric and each said bar face being concave so that said fabric curls at each edge as each bar is inserted thereunder and as each fabric edge passes over each bar;

said support means including means for adjusting the position of each of said bars transversely to the direction of said longitudinal movement of said upper surface so as to increase and decrease the amount of curl in each edge of said fabric; and means for preventing said fabric from running off the edge of said bars inserted under the side edge of said fabric in the course of its side to side motion, comprising end blocks, each of said end blocks being attached to a leading edge of each said bar.

4. In a Fourdrinier-type paper machine having a wet end with a headbox for storing pulp mixture and supported by a support frame, said pulp mixture being jetted onto a fabric having two side edges, said fabric forming an endless belt the upper surface of which is caused to continuously move longitudinally away from said headbox as well as side to side in the course of its longitudinal motion, an apparatus for supporting and curling said side edges of said fabric, comprising:

support means connected to said support frame;

a pair of bars, each supported by said support means, and each having a wedge-shaped cross-section, one edge of each bar being inserted under each side edge of said fabric, thus providing continuous support for curling each edge of said fabric upward for the length of the bars;

each of said bars having a face facing toward said fabric and each said bar face being concave so that said fabric curls at each edge as each bar is inserted thereunder and as each fabric edge passes over each bar;

means for preventing said fabric from running off the edge of said bars inserted under the side edge of said fabric in the course of its side to side motion, comprising end blocks, each of said end blocks being attached to a leading edge of each said bar;

said support means including means for adjusting the position of each of said bars transversely to the direction of said longitudinal movement of said upper surface so as to increase and decrease the amount of curl in each edge of said fabric; and said support means further including a plurality of places where said support means provide support to said bars, each said place having separate adjusting means for adjusting the position of said bars so as to increase and decrease the amount of curl in the edges of said fabric, each of said separate adjusting means being adjustable independently of each other.

5. An apparatus as recited in claim 2, claim 3 or claim 4, wherein each end block has a curved upper surface, the curve of which approximately matches that of the bar to which it is attached, except that the lower portion of the end block extends further under the fabric than does the lower portion of the bar.

* * * * *